US011649025B2

(12) United States Patent
Godoy

(10) Patent No.: US 11,649,025 B2
(45) Date of Patent: May 16, 2023

(54) BUOYANCY CONTROL DEVICE WITH A CONNECTION ADAPTOR BETWEEN A SNAP COUPLING TERMINAL OF A SHOULDER STRAP AND AN ARTICULATED CONNECTOR FASTENED TO THE BODY OF THE DEVICE

(71) Applicant: Cressi-Sub S.P.A., Genoa (IT)

(72) Inventor: Carlos Alberto Godoy, Genoa (IT)

(73) Assignee: Cressi-Sub S.P.A., Genoa (IT)

( * ) Notice: Subject to any disclaimer, the term of this patent is extended or adjusted under 35 U.S.C. 154(b) by 3 days.

(21) Appl. No.: 17/344,262

(22) Filed: Jun. 10, 2021

(65) Prior Publication Data

US 2022/0073174 A1 Mar. 10, 2022

(30) Foreign Application Priority Data

Sep. 9, 2020 (IT) ..... 102020000021298

(51) Int. Cl.
*B63C 11/02* (2006.01)

(52) U.S. Cl.
CPC ..... *B63C 11/02* (2013.01); *B63C 2011/026* (2013.01)

(58) Field of Classification Search
CPC ... B63C 2011/085; B63C 11/08; B63C 11/02; Y10T 24/4736; Y10T 24/4093; A44B 11/2549; A44B 11/266
USPC ..... 405/186
See application file for complete search history.

(56) References Cited

U.S. PATENT DOCUMENTS 5,011,334 A * 4/1991 Vorhauer ..... B63C 11/08 2/24
5,249,890 A * 10/1993 Bergstrom ..... B63C 11/02 405/185
5,346,419 A * 9/1994 Kaiser ..... B63C 11/08 441/96
5,860,769 A * 1/1999 Seligman ..... A44B 11/263 224/264

FOREIGN PATENT DOCUMENTS

DE 102016214526 A1 * 2/2018
EP 0908383 A1 * 4/1994
EP 0853037 A2 * 7/1998
WO WO 00/70987 A1 * 11/2000
WO WO 2009/103279 A2 * 8/2007

OTHER PUBLICATIONS

Machine Translation of DE 102016214526, pp. 9 (Year: 2018).*

* cited by examiner

*Primary Examiner* — Sunil Singh
(74) *Attorney, Agent, or Firm* — Blank Rome LLP

(57) ABSTRACT

A buoyancy control device for scuba diving comprising at least two shoulder straps, each shoulder strap having an upper portion and a lower portion joined by a closing buckle comprising a male buckle element and a female buckle element, which has a first connection means for connecting to the upper portion of the shoulder strap and a second connection means for connecting to the male buckle element, wherein the female buckle element comprises a first part that has the first connection means, a second part that has the second connection means, and an articulated connection pin for connecting the first part to the second part.

11 Claims, 6 Drawing Sheets

BUOYANCY CONTROL DEVICE WITH A CONNECTION ADAPTOR BETWEEN A SNAP COUPLING TERMINAL OF A SHOULDER STRAP AND AN ARTICULATED CONNECTOR FASTENED TO THE BODY OF THE DEVICE

RELATED APPLICATIONS

This application claims benefit of priority of Italy Application No. 102020000021298, filed Sep. 9, 2020. The above-identified related application is incorporated by reference.

FIELD OF USE

The present invention relates to a buoyancy control device for scuba diving comprising at least two shoulder straps, each shoulder strap having an upper portion and a lower portion joined by a closing buckle comprising a male buckle element and a female buckle element, which has a first connection means for connecting to the upper portion of the shoulder strap and a second connection means for connecting to the male buckle element.

BACKGROUND OF THE INVENTION

Buoyancy control devices (BCD) have been present on the market for some time as individual accessories for scuba diving used to increase the diver's ability to control the level of depth to be maintained or varied during a dive.

A BCD substantially consists of an expandable bladder, generally made of synthetic materials, worn like a jacket into which air coming from the cylinder is injected, and whose volume is regulated by inflation and deflation valves directly controlled by the diver: the increase or decrease in volume has a direct effect on hydrostatic thrust and therefore helps the diver to maintain or reach the hydrostatic balance required and desired at the various diving depths.

In the forms used, the BCD also has, on the rear dorsal part thereof, systems for securing the compressed air cylinder, as well as other elements for securing other accessories used during diving.

Good wearability of the BCD for the diver and the adherence thereof to the body are thus of extreme importance, both during the preparatory phases prior to the dive and, even more importantly, during the dive itself.

The BCD is worn by the diver like a backpack/vest, with two adjustable shoulder straps and a quick-coupling abdominal closing strap, normally integrated with a superimposable Velcro strap: the importance of the optimal conditions of wearability and comfort that such wearable elements must be able to guarantee in order to ensure the total safety of the diver during the dive is thus clearly evident.

During the inflation and deflation process, the expandable bladder also substantially changes its configuration: the change in size can cause a subsequent tightening or loosening of the constraints of the device around the diver's body, compromising the comfort thereof during the dive.

It is known that in order to remedy this drawback, various buoyancy control devices propose systems for securing the device to the diver's body which have a wide variety of adjustment systems, including systems allowing the relative rotation of reciprocal fastening elements.

It is known that U.S. Pat. No. 5,860,769 A proposes several solutions in this regard.

As is known, such solutions entail complex, particularly costly materials with a specific design.

There is thus a felt need to simplify the structure of the known buoyancy control devices for scuba diving.

SUMMARY OF THE INVENTION

The technical task of the present invention is therefore to provide a buoyancy control device for scuba diving which enables the aforesaid technical drawbacks of the prior art to be eliminated.

Within the scope of this technical task, one object of the invention is to provide a buoyancy control device for scuba diving that comprises at least two shoulder straps, wherein each shoulder strap has two portions joined by a closing buckle that allows the relative rotation of the two portions and uses simple, standard, and inexpensive closure systems.

Another object of the invention is to provide a buoyancy control device wherein the closing buckle of the shoulder straps has optimal characteristics of resistance to the tensile forces acting on the buckle itself.

Yet another object of the invention is to provide a buoyancy control device wherein the closing buckle of the shoulder straps guarantees the possibility of relative rotation of the two portions also under conditions of high tensile forces.

The technical task, as well as these and other objects, according to the present invention are achieved by providing a buoyancy control device for scuba diving comprising at least two shoulder straps, each shoulder strap having an upper portion and a lower portion joined by a closing buckle, said buckle comprising a male buckle element and a female buckle element having a first connection means for connecting to said upper portion of said shoulder strap and a second connection means for connecting to said male buckle element, characterised in that said female buckle element comprises a first part having said first connection means, a second part having said second connection means, and an articulated connection pin for connecting said first part to said second part.

Other features of the present invention are defined, moreover, in the subsequent claims.

BRIEF DESCRIPTION OF THE DRAWINGS

Additional features and advantages of the invention will be more apparent from the description of a preferred, but not exclusive embodiment of a buoyancy control device for scuba diving comprising at least two shoulder straps according to the invention, illustrated by way of non-limiting example in the appended drawings, in which.

DETAILED DESCRIPTION OF THE ILLUSTRATED EMBODIMENTS

Figure 1:
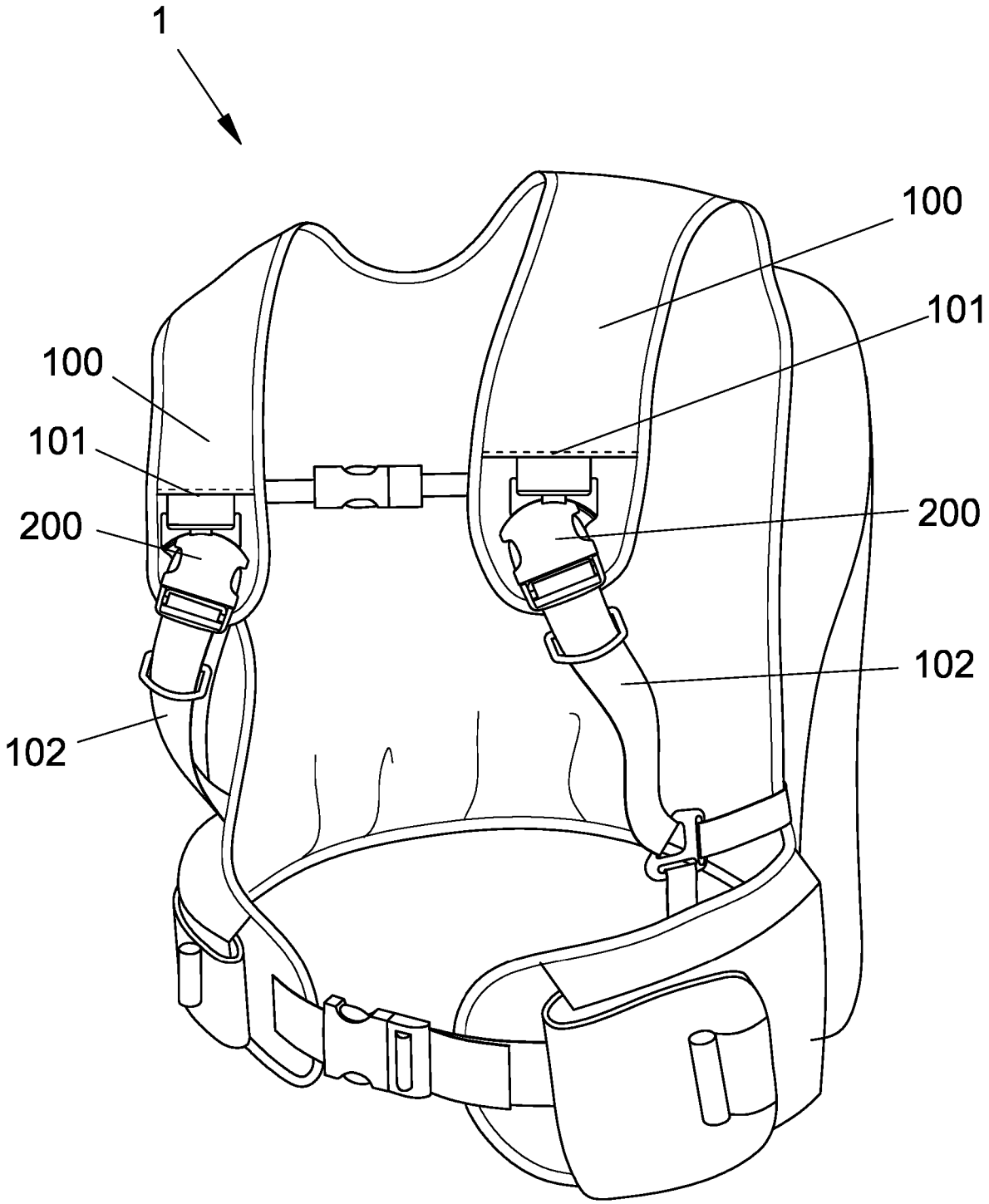
FIG. 1 shows an overall view of a buoyancy control device.
Figure 2:
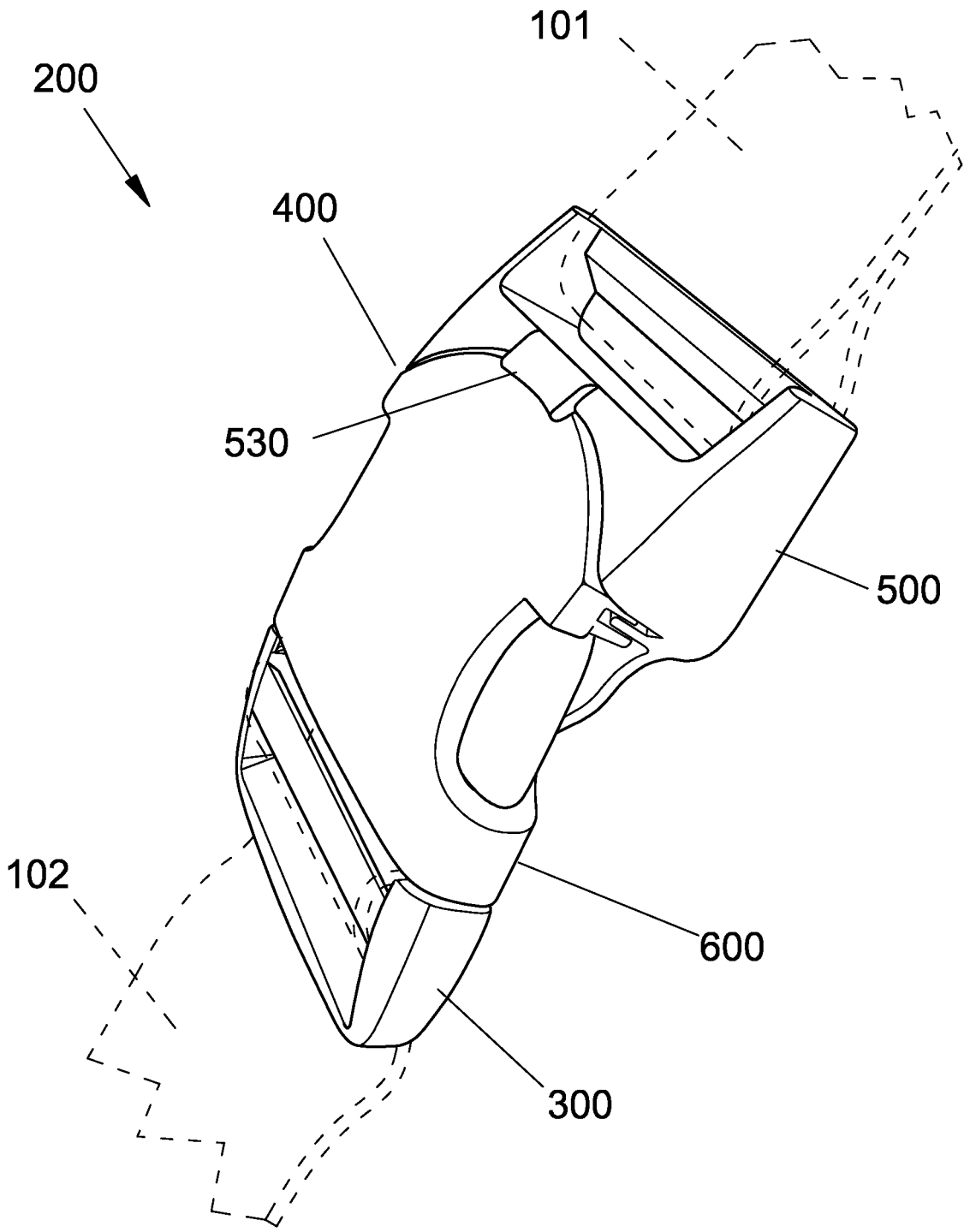
FIG. 2 shows an overall view of a closing buckle of a shoulder strap.
Figure 3A:
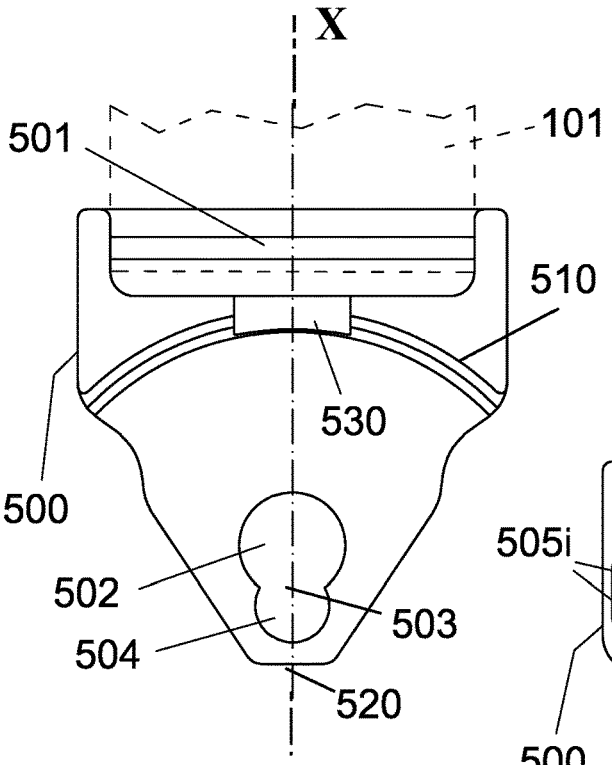
FIG. 3*a* shows a top view and FIG. 3*b* a bottom view of the first part of the female element of the buckle.
Figure 3B:
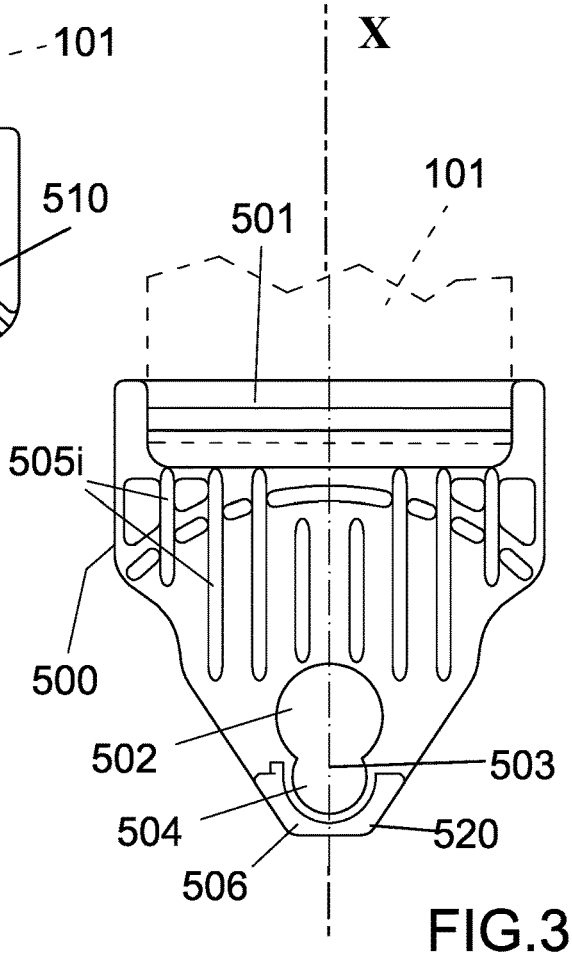
Figure 4A:
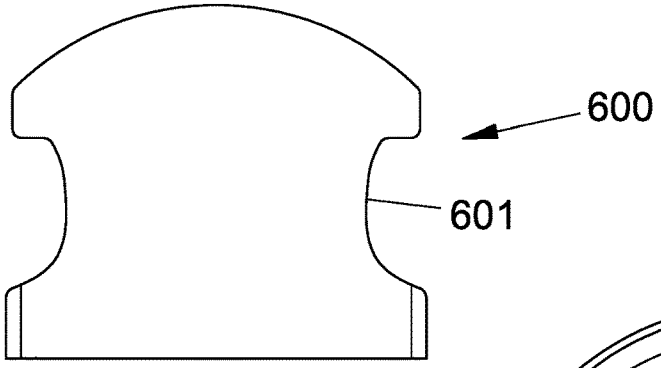
FIG. 4*a* shows a top view and a FIG. 4*b* a bottom view of the second part of the female element of the buckle.
Figure 4B:
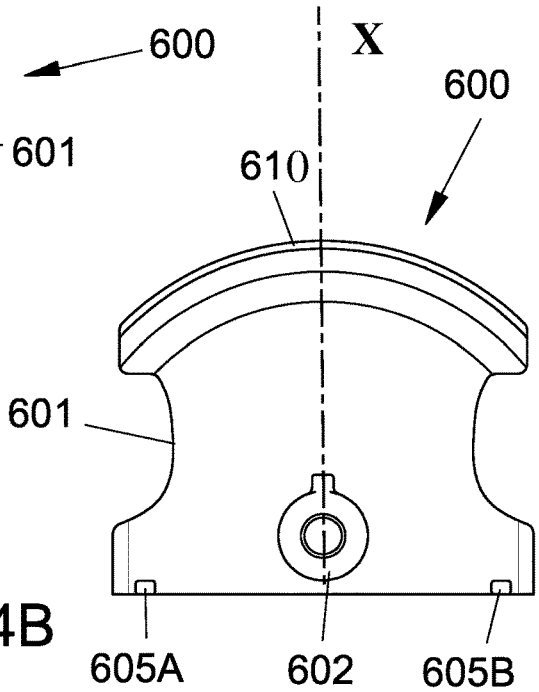
Figure 5A:
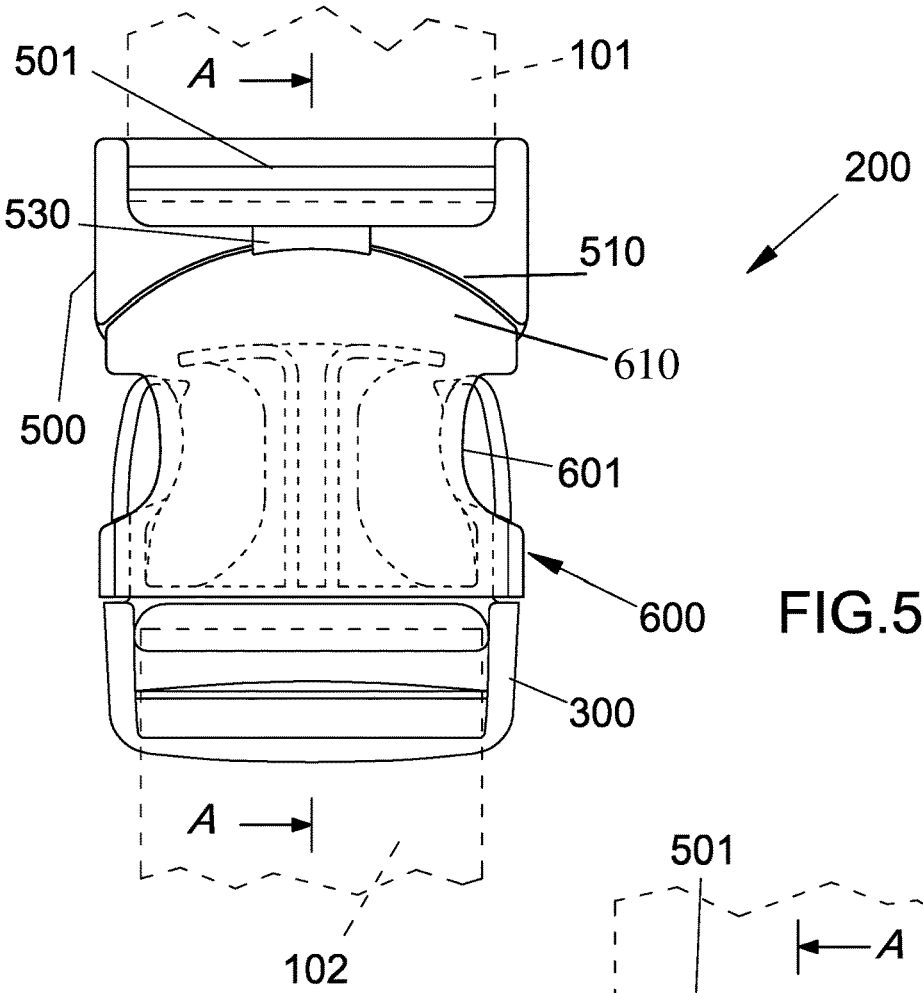
FIG. 5*a* shows a top view and FIG. 5*b* a bottom view of the closed buckle.
Figure 5B:
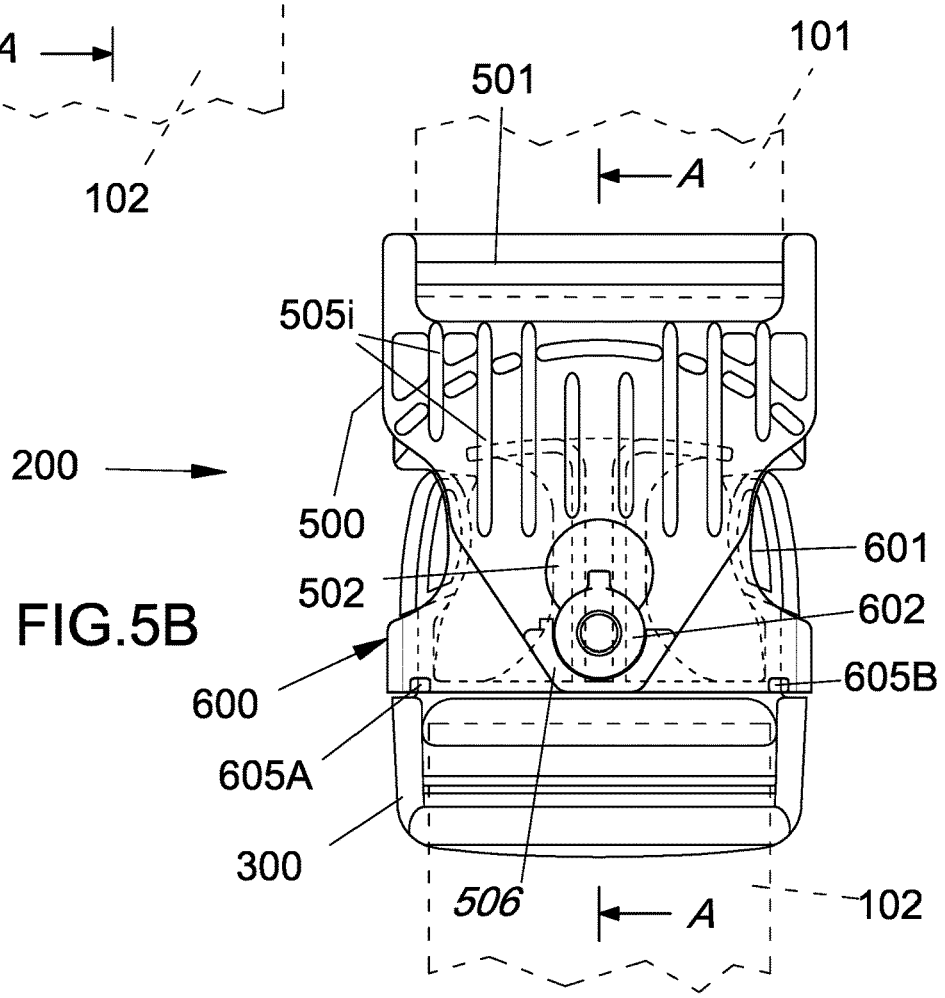
Figure 6:
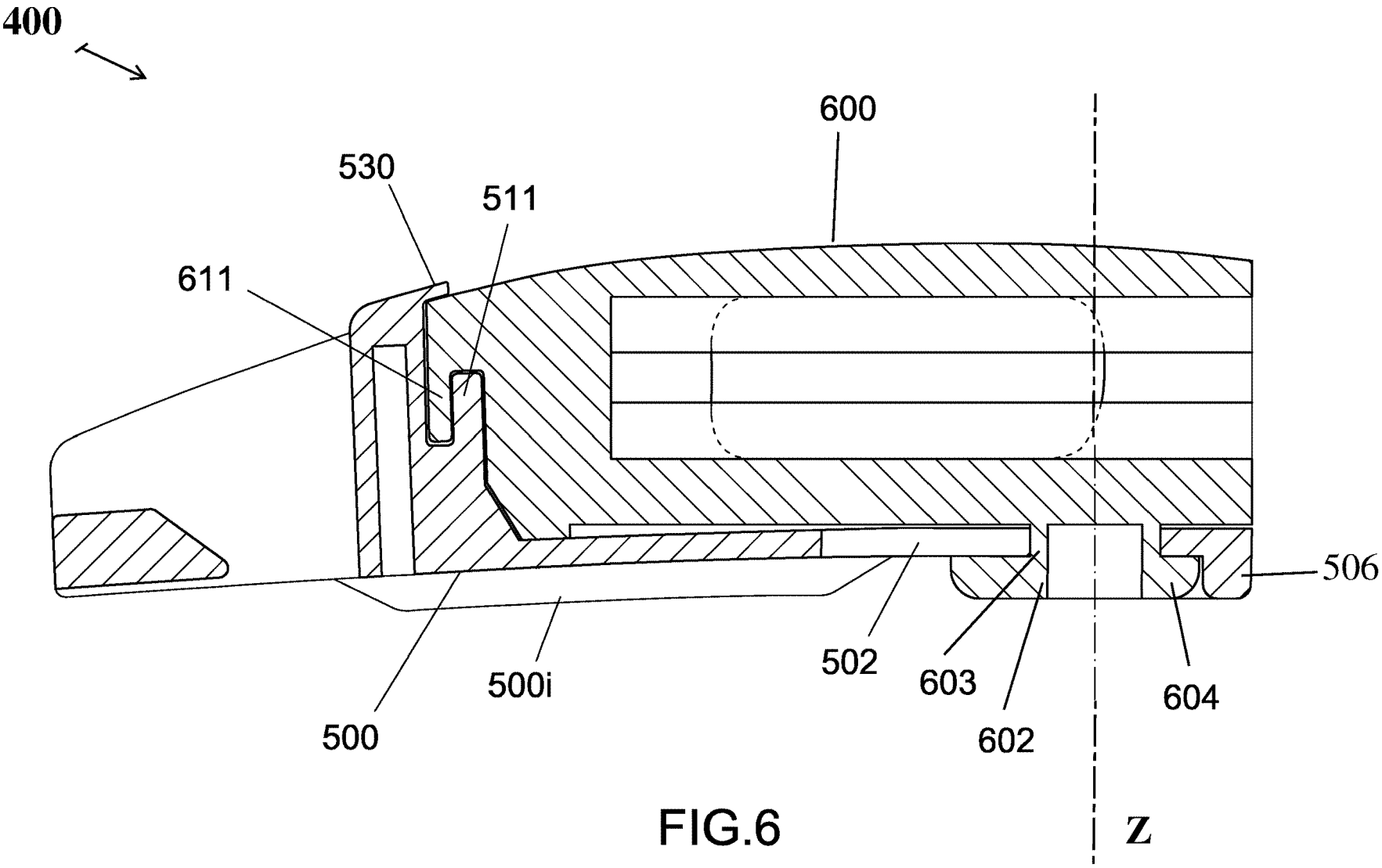
FIG. 6 shows a section AA of the closed buckle.
Figure 7A:
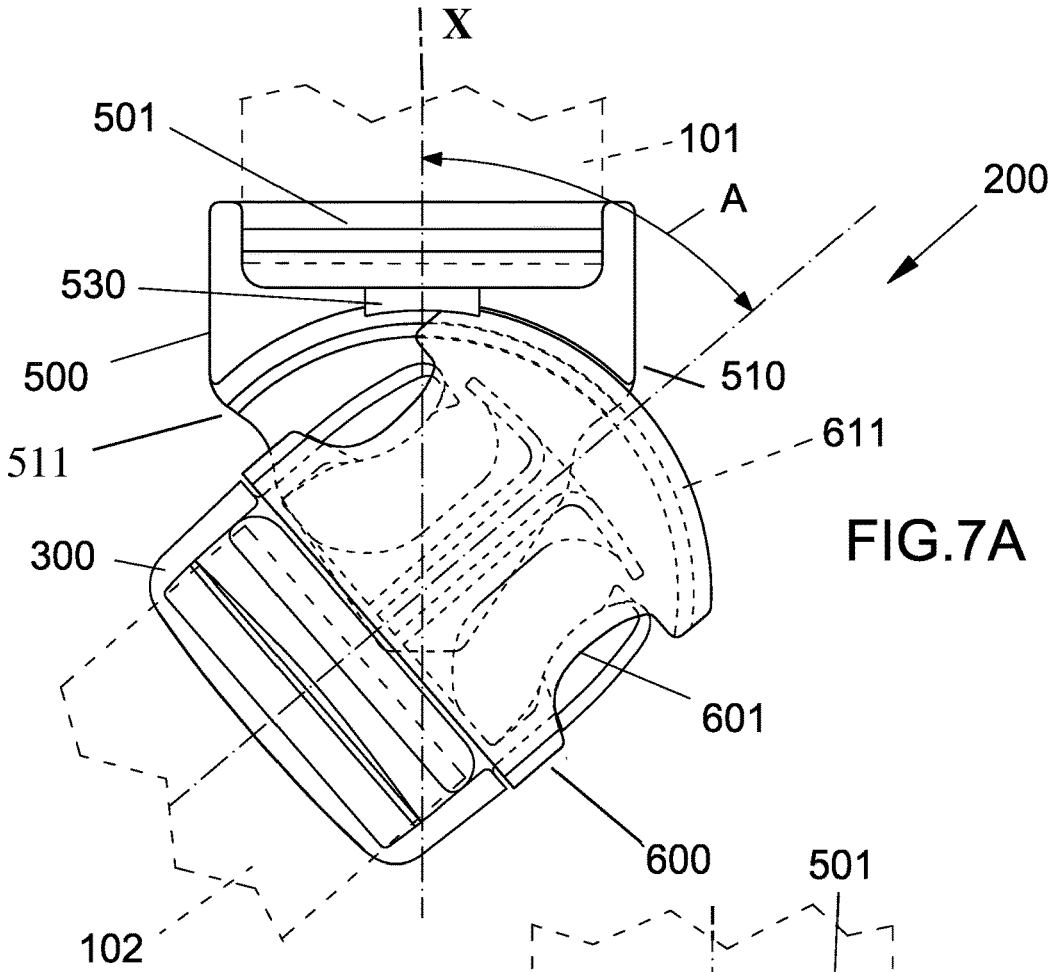
FIG. 7*a* shows a top view and FIG. 7*b* a bottom view of the closed buckle, with an indication of the maximum angle of relative rotation of the first part and the second part.
Figure 7B:
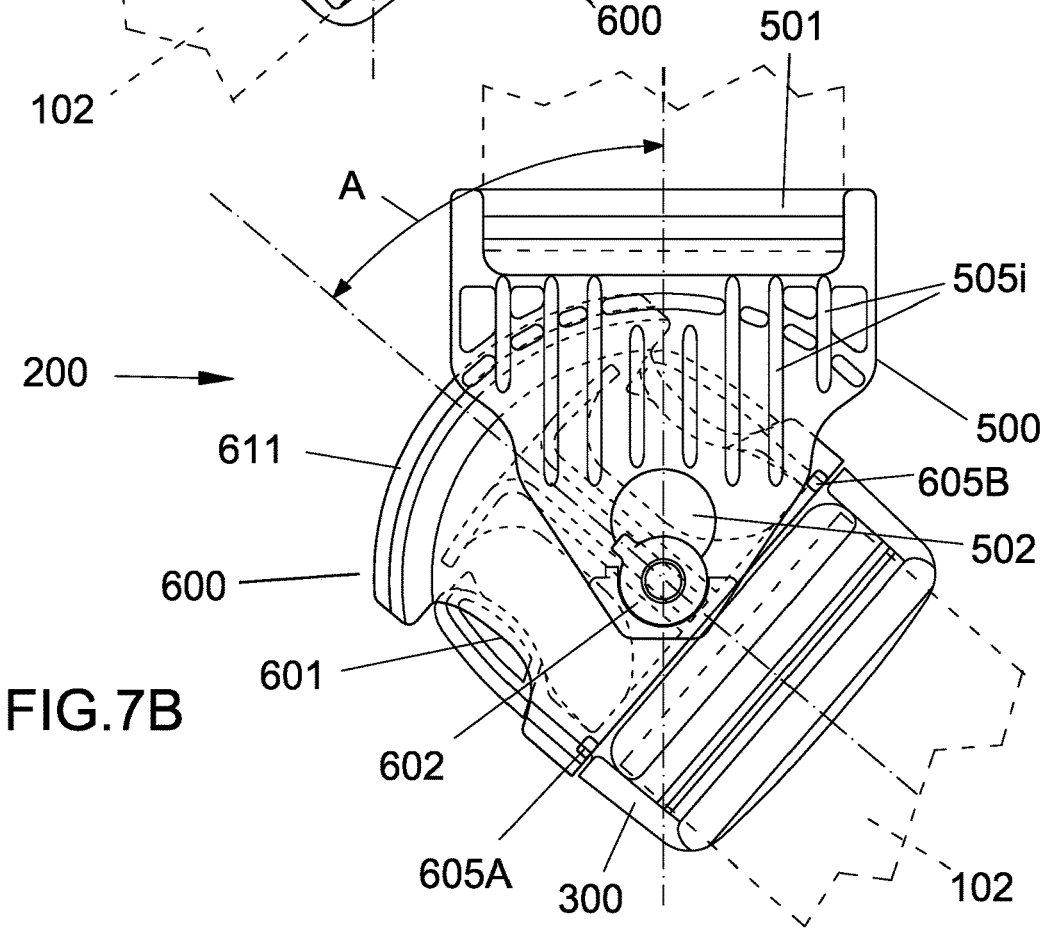

With reference to the aforementioned figures, they show a buoyancy control device for scuba diving denoted in its entirety by the reference number 1.

The buoyancy control device comprises at least two shoulder straps 100; each shoulder strap 100 has an upper portion 101 and a lower portion 102 joined by a closing buckle 200.

The upper portion 101 and the lower portion 102 of the shoulder strap are typically made of a polymeric material, woven or braided, with characteristics of high tensile strength, typically in a standard width of 50 mm.

The upper portion 101 is generally of a limited length, and is directly fastened at one end to the upper body of the buoyancy control device at the diver's shoulder.

The lower portion 102 is generally the portion of greater length and is fastened at one end to the lower part of the buoyancy control device, directly or through other wearable elements of the device.

The buckle 200 comprises at least one male buckle element 300 and one female buckle element 400.

Advantageously, according to the first preferred embodiment of the present invention, the male buckle element 300 is a known element of a reciprocally elastic fastening system of a fast type, which is widely disseminated, readily available and low-cost.

The male buckle element 300 is fastened to the free end of the lower portion 102 by means of a known connection means, also adjustable, which is not shown in the figures.

Advantageously, according to the first preferred embodiment of the present invention, the female buckle element 400 comprises a first part 500 that comprises a first connection means 501 for connecting to the free end of the upper portion 101 of the shoulder strap 100.

In the present preferred embodiment, the connection means 501 is of a known type and reciprocally secures the first part 500 of the female buckle element 400 to the upper portion 101 of the shoulder strap 100.

The female buckle element 400 comprises a second part 600 that comprises a second connection means 601 for connecting to the male buckle element 300: advantageously, according to the present invention, the second connection means 601 is a known means, with a simple and standardized design, and consistent with a reciprocally elastic fastening system of a fast type, which is widely disseminated, readily available and low-cost.

Advantageously, according to the present invention, the first part 500 and the second part 600 of the female buckle element 400 are connected by means of an articulated connection pin 602.

The articulated connection pin 602 extends along a Z axis which is orthogonal to the main plane in which the female buckle element 400 lies and allows the relative rotation of the first part 500 and the second part 600 in parallel planes, orthogonal to the Z axis.

The articulated connection pin 602 is integral with the second part 600 of the female buckle element 400, and is obtained by monolithic moulding of the second part 600 in a single piece made of polymeric material, preferably acetal resin.

Consistently, the first part 500 is likewise obtained by monolithic moulding in a single piece made of polymeric material, preferably acetal resin.

The articulated connection pin 602 is preferably cylindrical in shape, has a shaft 603 and a head 604 of a larger diameter than the shaft 603, and is of a size consistent with the forced elastic passage of the head 604 in the direction of the Z axis through a circular hole 502 provided in the first part 500, in the area towards the terminal end 520 in a position opposite the first connection means 501.

The circular hole 502 has an axial extension 503 along an axis X coinciding with the longitudinal middle axis of the closing buckle 200 and substantially coinciding with the middle axis of the shoulder strap 100, in the further direction of the terminal end 520 in an opposite position to the first connection means 501.

The axial extension 503 has a size and shape adapted to receive the shaft 603 slidingly towards the terminal end 520: the diameter of the shaft 603 is smaller than the transversal dimension of the extension 503 and allows the rotation thereof integrally with the second part 600; the diameter of the head 604 is larger than the transversal dimension of the extension 503 and prevents the extraction thereof in the direction of the Z axis.

Consequently, the first part 500 of the female buckle element 400 is rotatably integral with the second part 600 by means of said articulated connection pin 602.

In accordance with at least one innovative feature of the present invention, the first part 500 and the second part 600 of the female buckle element 400 have cooperating means, respectively 510 and 610, for opposing the tensile forces N of the shoulder strap acting on said female buckle 400.

The cooperating means 510 and 610 are positioned at the ends of the first part 500 opposite the terminal end 520, and at the end of the second part 600 opposite the terminal end 520 near the position of the articulated connection pin 602, along the longitudinal middle axis X.

The cooperating means 510 and 610 for opposing the tensile forces N comprise at least two conjugate lips, respectively a first internal lip 511 on the first part 500 and a second external lip 611 on the second part 600, reciprocally engaged.

The first internal lip 511 and the second external lip 611 extend along a circumferential arc with its centre coinciding with the Z axis of the articulated connection pin 602.

Advantageously, the first internal lip 511 and second external lip 611 remain reciprocally engaged during the relative rotation of the second part 600 with respect to the first part 500 about the Z axis of the articulated connection pin 602.

The second part 600 has two lateral protrusions 605A, 605B that are symmetrical with respect to the longitudinal axis X, and which, in the relative rotation of said second part 600 about the articulated connection pin 602, engage alternately with the lateral walls of the first part 500, limiting the maximum angle of relative rotation A between the first part 500 and the second part 600 to the corresponding circumferential arc on which the conjugate first internal lip 511 and second external lip 611 remain reciprocally engaged.

On the longitudinal axis X, the first part 500 has an upper element 530 projecting over said second part 600 at the cooperating means 510 and 610; the projecting upper element 530 does not prevent the relative rotation of the second part 600 about the articulated connection pin 602, but prevents the exit thereof from the plane of relative rotation and the overturning of the end according to the Z axis, and the consequent disengagement of the first internal lip 511 from the second external lip 611.

Conveniently, the upper element 530 is projecting over the second part 600 up to the maximum angle of relative rotation A with respect to the first part 500 defined by the alternate engagement of the two lateral protrusions 605A, 605B, which are symmetrical with the lateral walls of the first part 500.

The first part 500 also has, on the lower surface opposite the relative sliding surface during rotation of the first part 500 and the second part 600, a plurality of projecting ribs 505*i* parallel to the X axis and a protrusion 506 enveloping the terminal end 520.

The plurality of ribs 505*i* and the protrusion 506 constitute a reinforcement of the stiffness and resistance of the first part 500 when it is subjected to the axial action of the tensile forces N at the cooperating means 610 and at the articulated connection pin 602.

The operation of the buoyancy control device for scuba diving according to the invention appears clear from what is described and illustrated and, in particular, is substantially the following.

The male buckle element 300, fastened to the free end of the lower portion 102 of the shoulder strap, is elastically engaged with the connection means 601 of the second part 600 of the female buckle element.

The second part 600 is free to rotate relative to the first part 500 by means of the articulated connection pin 602 engaged in the axial extension 503 of the first part 500.

The upper portion 101 of the shoulder strap 100 is fastened and reciprocally secured by the connection means 501 to the first part 500 of the female buckle element 400.

The tensile forces N acting in an equally and contrary manner on the two portions 101 and 102 of the shoulder strap along the X axis of the closing buckle 200, transfer their load to the buckle 200 at the connection means 601 of the second part 600 and the means 501 of the first part 500.

The loads of the tensile forces are reciprocally transferred from the first part 500 to the second part 600 by means of the articulated connection pin 602.

The articulated connection pin 602 is made of polymeric material, preferably acetal resin.

Whenever the loads of the tensile forces N are particularly high, the elastic deformation of the shaft 603 of the pin 602 will cause a relative sliding of the first part 500 with respect to the second part 600 in a substantially axial deformation along the X axis of the buckle 200.

The relative sliding brings the cooperating means 510 and 610 closer and causes the operative engagement thereof by reciprocally engaging the first internal lip 511 with the second external lip 611 along the entire circumferential arc engaged by the reciprocal rotation of the first part 500 and second part 600.

The large extent of the reciprocally engaged conjugate surfaces of the internal lip 511 and the external lip 611 and the stiffness and resistance of the first part 500 increased by the plurality of ribs 505*i* and the protrusion 504 enable the transfer, in safety, of the tensile loads N, also considerable ones, between the first part 500 and the second part 600 of the female buckle element 400 of the closing buckle 200, without preventing the reciprocal rotation thereof.

In practical terms, it has been observed that a buoyancy control device according to the invention is particularly advantageous due to the possibility that the closing buckle may allow the relative rotation of the two portions and use simple, standard, and low-cost closure systems.

A buoyancy control device according to the invention is particularly advantageous, moreover, since the closing buckle of the shoulder straps has good characteristics of resistance to the tensile forces acting on the buckle itself.

A buoyancy control device thus conceived is susceptible of numerous modifications and variants, all falling within the scope of the inventive concept as defined by the subsequent claims.

Furthermore, all of the details are replaceable by technically equivalent elements.

The materials used, as well as the dimensions, may in practice be any whatsoever, according to needs and the state of the art.

The invention claimed is:

1. A buoyancy control device (1) for scuba diving comprising at least two shoulder straps (100), each shoulder strap having an upper portion (101) and a lower portion (102) joined by a closing buckle (200), said buckle comprising a male buckle element (300) and a female buckle element (400) having a first connection means (501) for connecting to said upper portion (101) of said shoulder strap (100) and a second connection means (601) for connecting to said male buckle element (300), wherein:

said female buckle element (400) comprises a first part (500) having said first connection means (501), a second part (600) having said second connection means (601), and an articulated connection pin (602) for connecting said first part (500) to said second part (600);

said first part (500) and said second part (600) of said female buckle element (400) have cooperating means (510, 610) for opposing tensile forces N of the shoulder strap acting on said female buckle element (400), said cooperating means (510, 610) being operative when said articulated connection pin (602) undergoes an elastic deformation as a result of said tensile forces N;

said cooperating means (510, 610) for opposing the tensile forces N comprise at least two conjugate lips, respectively a first internal lip (511) on said first part (500) and a second external lip (611) on said second part (600), reciprocally engaged;

said first internal lip (511) and said second external lip (611) extend along a circumferential arc with its center coinciding with a Z axis of said articulated connection pin (602); and said first part (500) has an upper element (530) projecting over said second part (600) at the cooperating means (510,610) and which prevents: an exit of the second part (600) from a plane of relative rotation of the first part (500) relative to the second part (600); an overturning of an end of the second part (600) according to the Z axis, and a consequent disengagement of the first internal lip (511) from the second external lip (611).

2. The buoyancy control device (1) according to claim 1, wherein said cooperating means (510, 610) are positioned at the ends of said first part (500) and said second part (600) opposite the position of said articulated connection pin (602) along the longitudinal middle axis X.

3. The buoyancy control device (1) according to claim 2, wherein said articulated connection pin (602) is made of acetal resin.

4. The buoyancy control device (1) according to claim 3, wherein said articulated connection pin (602) is integral with said second part (600) of said female buckle element (400).

5. The buoyancy control device (1) according to claim 4, wherein said first part (500) of said female buckle element (400) is rotatably integral with said second part (600) by means of said articulated connection pin (602).

6. The buoyancy control device (1) according to claim 1, wherein said first part (500) has a plurality of ribs (505*i*) and a protrusion (506) enveloping a terminal end (520) for reinforcing axial action of said tensile forces N at said cooperating means (510, 610) and said articulated connection pin (602).

7. The buoyancy control device (1) according to claim 1, wherein said second part (600) has two lateral protrusions (605A, 605B) symmetrical with respect to a longitudinal axis X, and which, in the relative rotation of said second part (600) about said articulated connection pin (602), engage alternately with lateral walls of said first part (500), limiting the maximum angle of relative rotation A between said first part (500) and said second part (600) to a corresponding circumferential arc on which said conjugate first internal lip (511) and second external lip (611) remain reciprocally engaged.

8. The buoyancy control device (1) according to claim 1, wherein said male buckle element (300) is an element of a reciprocally elastic fastening system of the fast type.

9. The buoyancy control device (1) according to claim 1, wherein both said first part (500) and said second part (600) of said female buckle element (400) are obtained by monolithic moulding in a single piece made of acetal resin.

10. A buoyancy control device (1) for scuba diving comprising at least two shoulder straps (100), each shoulder strap having an upper portion (101) and a lower portion (102) joined by a closing buckle (200), said buckle comprising a male buckle element (300) and a female buckle element (400) having a first connection means (501) for connecting to said upper portion (101) of said shoulder strap (100) and a second connection means (601) for connecting to said male buckle element (300), wherein:

said female buckle element (400) comprises a first part (500) having said first connection means (501), a second part (600) having said second connection means (601), and an articulated connection pin (602) for connecting said first part (500) to said second part (600); and said first part (500) and said second part (600) of said female buckle element (400) have cooperating means (510, 610) for opposing tensile forces N of the shoulder strap acting on said female buckle (400), said cooperating means (510, 610) being operative when said articulated connection pin (602) undergoes an elastic deformation as a result of said tensile forces N; and said first part (500) has a plurality of ribs (505*i*) and a protrusion (506) enveloping a terminal end (520) for reinforcing axial action of said tensile forces N at said cooperating means (510, 610) and said articulated connection pin (602).

11. A buoyancy control device (1) for scuba diving comprising at least two shoulder straps (100), each shoulder strap having an upper portion (101) and a lower portion (102) joined by a closing buckle (200), said buckle comprising a male buckle element (300) and a female buckle element (400) having a first connection means (501) for connecting to said upper portion (101) of said shoulder strap (100) and a second connection means (601) for connecting to said male buckle element (300), wherein:

said female buckle element (400) comprises a first part (500) having said first connection means (501), a second part (600) having said second connection means (601), and an articulated connection pin (602) for connecting said first part (500) to said second part (600); and said first part (500) and said second part (600) of said female buckle element (400) have cooperating means (510, 610) for opposing tensile forces N of the shoulder strap acting on said female buckle (400), said cooperating means (510, 610) being operative when said articulated connection pin (602) undergoes an elastic deformation as a result of said tensile forces N;

said cooperating means (510, 610) for opposing the tensile forces N comprise at least two conjugate lips, respectively a first internal lip (511) on said first part (500) and a second external lip (611) on said second part (600), reciprocally engaged; and said second part (600) has two lateral protrusions (605A, 605B) symmetrical with respect to a longitudinal axis X, and which, in the relative rotation of said second part (600) about said articulated connection pin (602), engage alternately with lateral walls of said first part (500), limiting the maximum angle of relative rotation A between said first part (500) and said second part (600) to a corresponding circumferential arc on which said conjugate first internal lip (511) and second external lip (611) remain reciprocally engaged.

* * * * *